US005419087A

United States Patent [19]

Haddy

[11] Patent Number: 5,419,087

[45] Date of Patent: May 30, 1995

[54] ABRASIVE SHEET HOLDING SANDING DEVICE

[76] Inventor: Charles M. Haddy, 24091 Novia Cir., Mission Viejo, Calif. 92691

[21] Appl. No.: 74,030

[22] Filed: Jun. 4, 1993

[51] Int. Cl.[6] ..... B24D 15/04

[52] U.S. Cl. ..... 451/344; 451/354

[58] Field of Search ..... 51/391, 392, 393, 364, 51/170 PT, 170 R, 170 TL, 180; 15/244.1

[56] References Cited

U.S. PATENT DOCUMENTS

| | | | |
|---|---|---|---|
| 2,094,894 | 10/1937 | Johnson | 51/364 |
| 2,131,676 | 9/1938 | Seifert | 15/244.1 |
| 2,225,101 | 12/1940 | Conk et al. | 15/244.1 |
| 2,853,838 | 9/1958 | Richards | 51/170 PT |
| 3,003,505 | 10/1961 | Otto et al. | 15/244.1 |
| 4,571,769 | 2/1986 | Ford | 15/244.1 |

FOREIGN PATENT DOCUMENTS

| | | | |
|---|---|---|---|
| 1168829 | 9/1958 | France | 15/244.1 |
| 3218009 | 11/1983 | Germany | 51/376 |
| 0048266 | 3/1985 | Japan | 51/392 |

*Primary Examiner*—Robert A. Rose

[57] ABSTRACT

A flexible polyurethane foam cylindrically shaped sanding device (1) manufactured from formulas of abrasive material, can be permanently surfaced with an abrasive material or layer and can be used in conjunction witch abrasive sheets.

The tube sheet (4) can be manufactured from wet or dry type abrasive sheets, perforated to allow for water penetration for wet sanding. The tube sheet is assembled into tube form by connection of the opposite edges of same abrasive sheet by fastening same sheet edge to edge by the adhesive tape (31) on back side of sheet, The sanding device is mountable to a pole by the mounting rod (81 ) which is run through mounting apparatus fork, through the sanding device center sleeve (21 ) and into the opposite threaded hole or inserted nut (82) or disc nut (89).

The mounting apparatus (84) is fastened to external pole (86) by screwing same pole into fitting on mounting apparatus. The opposite end of same exterior pole has the handle with compression fitting (87) which adjusts to compress against and hold the internal pole (85), with handle (88), which is contained within and slides through the external pole (86), screwing into the rotation stop brake (83) which slides along the two forks of the mounting apparatus (84) and locks the sanding device (2) from rotation on mounting rod.

A multitude of sanding devices can be assembled together end to end onto the mounting rod (81) for hand operation of larger working surfaces.

2 Claims, 12 Drawing Sheets

ABRASIVE SHEET HOLDING SANDING DEVICE

BACKGROUND-FIELD OF INVENTION

This invention concerns a flexible polyurethane foam sanding device, operated by hand or pole mounted, manufactured into a cylindrically shaped body from molded polyurethane foam combined with abrasive materials, surfaced with abrasive materials or used in conjunction with sandpaper, emery cloth or other surface conditioning products formed into a tube sheet, for the purpose of removing rust, paint and other surface objectionables, for smoothing, shaping, feathering, sanding or otherwise preparing, polishing, finishing or refinishing surfaces of a broad range of contours, including flat, on materials such as, wood, metal, fiberglass, plastics, foam, composition and any other type of painted or unpainted surfaces.

BACKGROUND-DESCRIPTION OF PRIOR ART

There are numerous devices in the prior art which are tools for sanding or shaping flat or contoured surfaces and for holding abrasive sheets for the purpose of said sanding or shaping.

Heretofore, the device consists of some form of a handle to which is fastened a flat or contoured cushioned pad to which is secured an abrasive sheet by use of a clamp.

U.S. Pat. No. 3,432,975, Parker, 1969 is a rigid sanding device requiring a handle and a clamp for holding the abrasive sheet. The sheet mounting surface is flat and limits the work surface to flat surfaces without contours and profiles. The device cannot be mounted to a pole, requires specially sized abrasive sheets which must be installed within and secured by clamps, a time consuming and cumbersome operation.

U.S. Pat. No. 3,483,662, Ames, 1969, Sander with Universal Handle and Lock is a flat sanding tool with a flat pad to accept the abrasive sheet requiring a clamp for securing said abrasive sheet. The work surface is limited to a flat surface without contours and profiles. The device requires specially sized sheets, is limited to flat working surfaces with its primary function for sanding walls and ceilings.

U.S. Pat. No. 3,562,967, Eriksen, 1969, is an abrasive sheet holding device consisting of two cast and machined rigid sections that are forced apart by a center adjusting screw, tightening an abrasive sheet onto the assembly. The device is not pole mountable, requires that the abrasive sheets be premanufactured sanding belts with said abrasive belts being difficult to keep aligned onto the working surface which is flat and limited to flat work surfaces free from contours and profiles.

U.S. Pat. No. 4,221,084, Frantzen, 1980 is a flat based sanding device consisting of a handle which snaps to the base which is manufactured with an etched metal surface for abrading and allows for the application of sandpaper if desired. The working surface of the device is flat limiting the opposing work surface to be flat and free from contours and profiles. The design allows for the abrasive sheet to be secured to the base by removal and replacement of the handle. The abrasive sheet must be cut from standard sheets or manufactured to fit. The method of securing the sandpaper to the device is time consuming, the abrasive sheet will work free from the base. The device can not be mounted to a pole.

U.S. Pat. No. 429,349, Rueb, 1991, is an elongated rigid sanding Block to which is fastened a cut to shape adhesive backed abrasive material. The working surface of the device is flat limiting the opposing work surface to be flat and free from contours and profiles. The location of the handle behind the working surface limits the amount of pressure to be applied to same working surface without the use of a second hand on top of the device pressing said device against opposing work surface. The device can not be pole mounted.

U.S. Pat. No. 4,361,990, Link, 1982 is a hand held sandpaper holding device designed to hold only a narrow strip of abrasive material which is run through and secured to said device by a buckle type clamp. The working surface is small limiting production of larger opposing work surfaces. The abrasive material must be manufactured or cut into narrow strips to precisely fit said device which is not pole mountable.

U.S. Pat. No. 4,516,360, Gringer, 1985, is an abrasive sheet holding device which is intended to be pole mounted, designed for flat surfaces free from contours and profiles, primarily wall and ceiling type surfaces. The abrasive sheets must be cut or manufactured to fit and secured to said device with clamps. The device is not designed to be hand held.

U.S. Pat. No. 4,688,356, Madzgalla, 1987 is a sanding belt holding device whereas the abrasive belt is held onto the device by the outward expansion of the device causing tension to secure abrasive material to said device. The shape of the tool makes operation difficult as when holding the device while applying pressure for the operation of said device the tension on the abrasive material to decrease allowing said abrasive material to be easily worked free or out of alignment. The shape of the device does not allow for comfortable grasp or grip for extended work periods. The working surface of said device is firm and flat limiting the opposing surface to be flat and free from contours and profiles. The device cannot be pole mounted.

U.S. Pat. No. 4,694,618, Eberhart, 1987, is an abrasive belt holding device hand operated by grasping a handle which is fatiguing to the hand and arm. The abrasive belts must be manufactured or cut to fit. The working surface is flat, limiting the opposing work surface to be flat and free from profiles The device cannot be pole mounted.

Several other patents have ben issued for hand operated sanding and shaping devices:

U.S. Pat. No. 4,825,597, Matechuk, 1990
U.S. Pat. No. 4,885,876, Henke, 1989
U.S. Pat. No. 4,928,343, Kissinger, 1990
U.S. Pat. No. 4,944,128, Reiter, 1990
U.S. Pat. No. 4,977,712, Fisher, 1990
U.S. Pat. No. 4,922,665, Wanatowicz, 1990
U.S. Pat. No. 5,054,248, Thayer, 1991
U.S. Pat. No. 5,131,193, Demers, 1992

These patented sanding devices require abrasive sheets to be manufactured to size or cut to fit from standard sized sheets, fastened to the devices' working surface, which is normally rigid and flat, with varying forms of clamps, hand operated, grasping some form of handle, are not capable of being both hand operated and pole mounted.

The industry standard sized abrasive sheets are manufactured to be 9 inches (22.9 cm) by 11 inches (28 cm). Cutting sheets to fit various sized and shaped devices is time consuming and wasteful of the remaining portions of the unused sheets. Non standard sized sheets are available but sometimes hard to find and not produced in similar quantities as standard sized sheets.

The fastening or securing of abrasive sheets to the device by use of clamping means is difficult and time consuming. The clamping system does not hold the sheet secure for long periods of time and generally requires a number of adjustments before the sheet becomes worn and is replaced with a new sheet.

The use of a handle to grasp the device and perform its intended operation or function is generally fatiguing to the arm and hand and requires the user to rest often.

Nevertheless, all sanding or abrasive sheet holding devices heretofore known suffer from a number of disadvantages:

a) Their manufacture requires the assembly by use of welds, screws, nuts and bolts of numerous cast, molded and machined parts involving handles, bases, pads and clamping systems.

b) They are typically limited to flat opposing work surfaces free from contours and detailed profiles, not capable of reaching hard to get areas such as inside corners. If the device is capable of contoured surfaces it is then limited by shape to that specific surface and not effective for flat surfaces or surfaces of different contours and profiles.

c) They require specially cut abrasive sheets cut from standard sized sheets or manufactured to fit the specific device. These pre cut sheets are not as widely available as the standard sized abrasive sheets.

d) Attachment of sheets to the device through clamping systems is difficult and time consuming, the user must free both hands for a long period of time to remove, replace tighten or secure and in some cases reassemble the entire device.

e) Abrasive sheets tend to work loose or off the device, do not wear evenly, with much of usable surface of the abrasive sheet being held within the clamping system and require replacement before the sheet is used to its maximum potential.

f) They are required to be held by a handle which is uncomfortable to grip, not conforming to a natural grip or grasp by the hand and will cause fatigue in the fingers hands and arms.

g) They do not absorb water to aid in the application of sanding processes requiring wet sanding as in metal finishing.

h) They are not capable of being pole mounted as for use in finishing walls, ceilings and floors, and if capable of being pole mounted are generally used for those purposes only as they are not designed to be grasped and operated by hand.

OBJECTS AND ADVANTAGES

Accordingly, several objects and advantages of my invention are:

a) To provide an easily operated, hand held and pole mountable sanding device which is comfortable to grasp or grip and can be used for extended periods of time without fatigue to the user.

b) To provide a sanding device which can be easily manufactured from inexpensive materials without expensive casting, machining, assembly and packaging.

c) To provide a sanding device which resists wear and eliminates functional obsolescence due to wear on working surfaces and clamping mechanisms resulting in untrue flat working surfaces and slippage of fastened abrasive sheets.

d) To provide a sanding device to which the securing of the abrasive sheet is performed quickly and easily without stopping work except for a very short time period and can essentially be performed without using both hands.

e) To provide a sanding device which can use 100% of its embodiment and when used in conjunction with abrasive sheets thereto attached will use 100% of said abrasive sheet.

f) To provide a sanding device which is unlimited to the shapes, contours and profiles of its opposing work surfaces and will universally conform, while in operation, to the shapes contours and profiles of the opposing work surfaces.

g) To provide a sanding device which can be manufactured to various compressive strengths allowing for flexibility and a wide range of resistance to the amount of pressure required to operate and to the contours and profiles of the opposing work surfaces.

h) To provide a sanding device which is capable of absorbing and releasing water when the device is used in conjunction with a wet type abrasive sheet for wet sanding as in metal finishing.

i) To provide a sanding device which is capable of being used universally for all types of sanding operations which can be either pole mounted as for walls, ceilings and floors or operated by grasping the device by hand and performing sanding operation.

Further objects and advantages of the present invention are that the device can be easily operated by a handicapped person and when used in conjunction with abrasive sheets, can be easily assembled and installed by most handicapped persons. The device is easily operated by persons with minimal mechanical abilities. The device can be made to a large range of sizes and shapes with the abrasive sheets being easily combined to make larger working surfaces and with the sanding device capable of not only larger sizes but used in connection with a second and third device connected and mounted together for hand operation or mounted to a wider rod and pole mount assembly for that type of operation, providing much increased working surfaces, greatly increasing the production of the operator of the sanding device.

DRAWING FIGURES

Figure 12C:
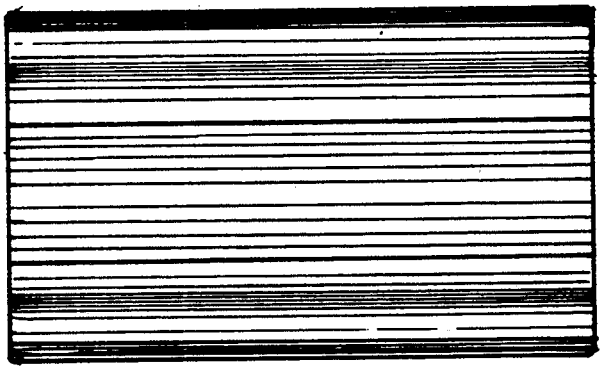
Figure 12B:
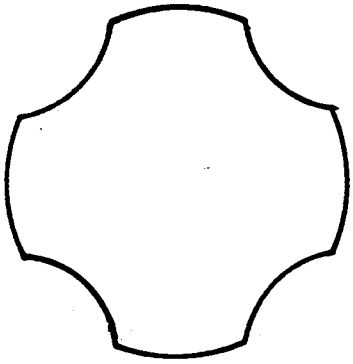
Figure 12A:
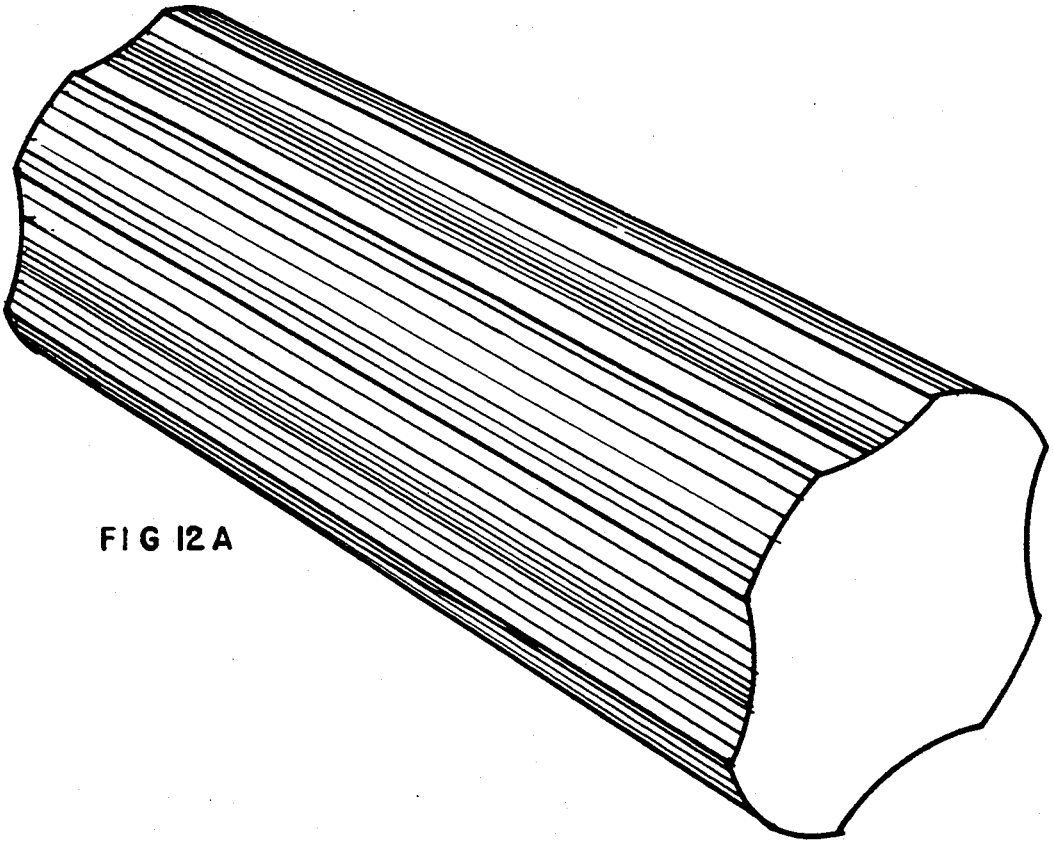

FIGS. 12A–C shows example of device of different shape with FIG. 12A showing a perspective view, FIG. 12B showing end view of device, and FIG. 12C showing a side view.

REFERENCE NUMERALS IN DRAWINGS

21) Pipe insert for mounting rod sleeve
31) Adhesive tape with removable protective strip
81) Roller rod with threaded end
82) Square headed nut threaded to match roller rod (81)
83) Rotation stop and break device
84) Mounting apparatus for sanding device
85) Internal pole for rotation stop blade
86) External pole for mounting apparatus
87) External pole handle with internal compression fitting
88) Internal pole handle
89) Disc with threaded hole to accept threaded mounting rod
90) Spacer disc

DESCRIPTION OF EMBODIMENTS

Figure 1:
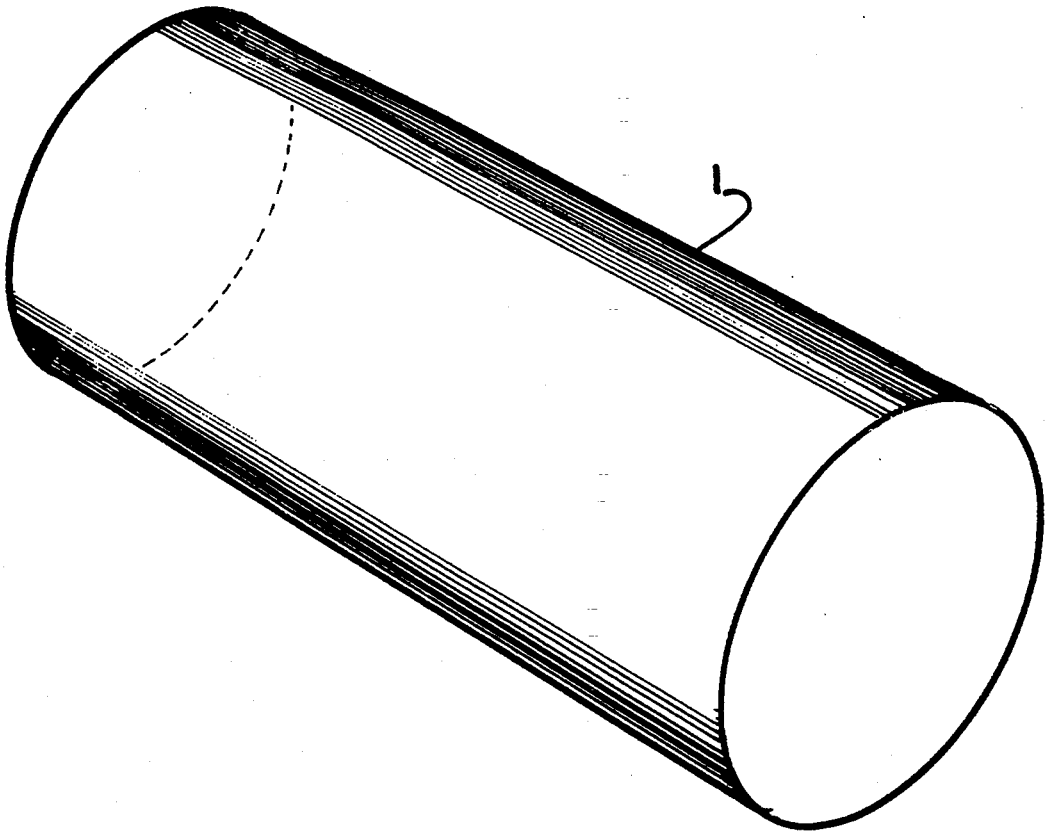
FIG. 1 shows basic embodiment (1), a flexible polyurethane cylindrically shaped sanding device and abrasive sheet holder.

The basic embodiment of the sanding device of this invention is illustrated in FIG. 1. The device is a one piece cylinder or modified cylinder form molded from flexible polyurethane foam. Manufactured by pressurized molding of the material, the device is capable of a wide range of shapes, sizes, densities and compressive strengths whereas the lesser the density of the device, the less resistance to and a greater ability to conform to the contours and profiles of the opposing work surfaces but still capable of being effective on flat surfaces. The greater the density of the device, the more resistance to compression providing a firm working surface better used when finishing flat opposing work surfaces thereby utilizing courser grit abrasive sheets.

Figure 2:
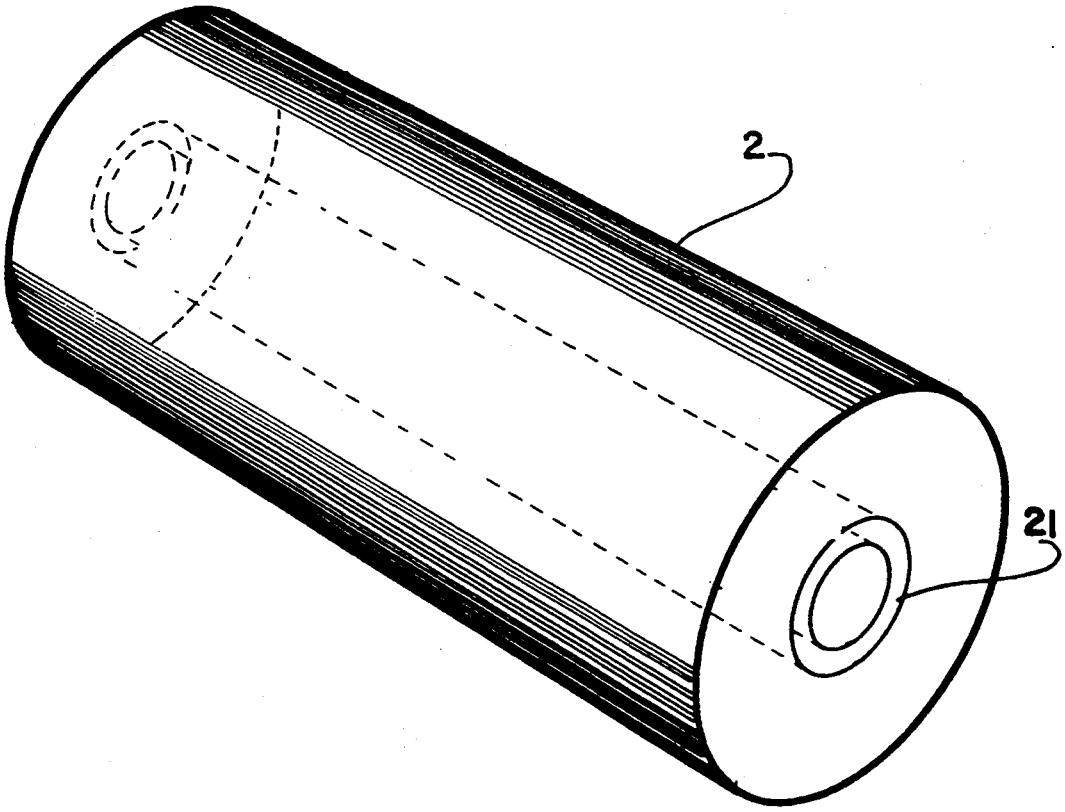
FIG. 2 shows sanding device (2) with a hole bored through center with sleeve (21) for pole mounting rod inserted.
Figure 3:
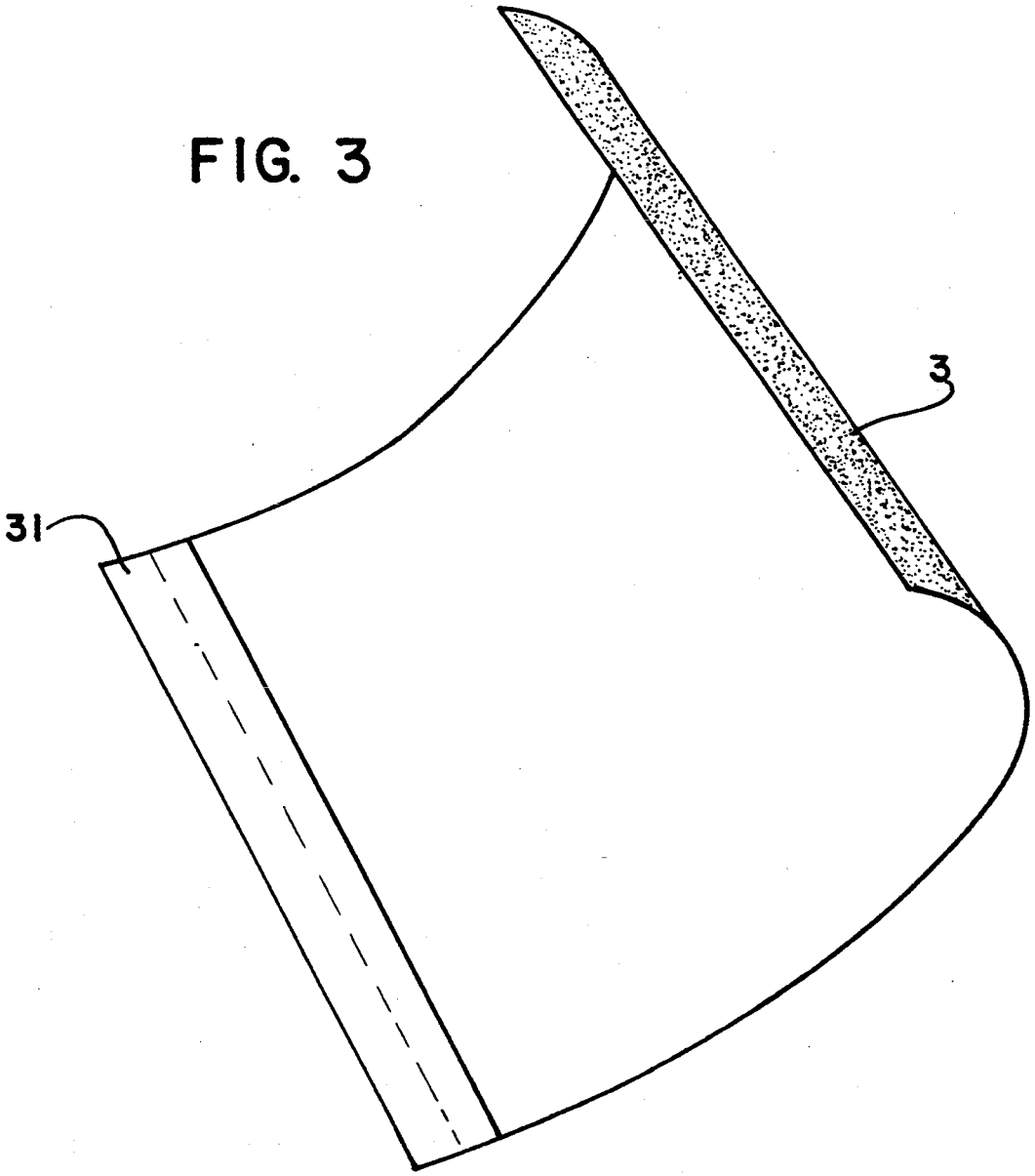
FIG. 3 shows abrasive sheet (3) with adhesive tape (31) fastened on the back side prior to assembly into tube sheet form.
Figure 4:
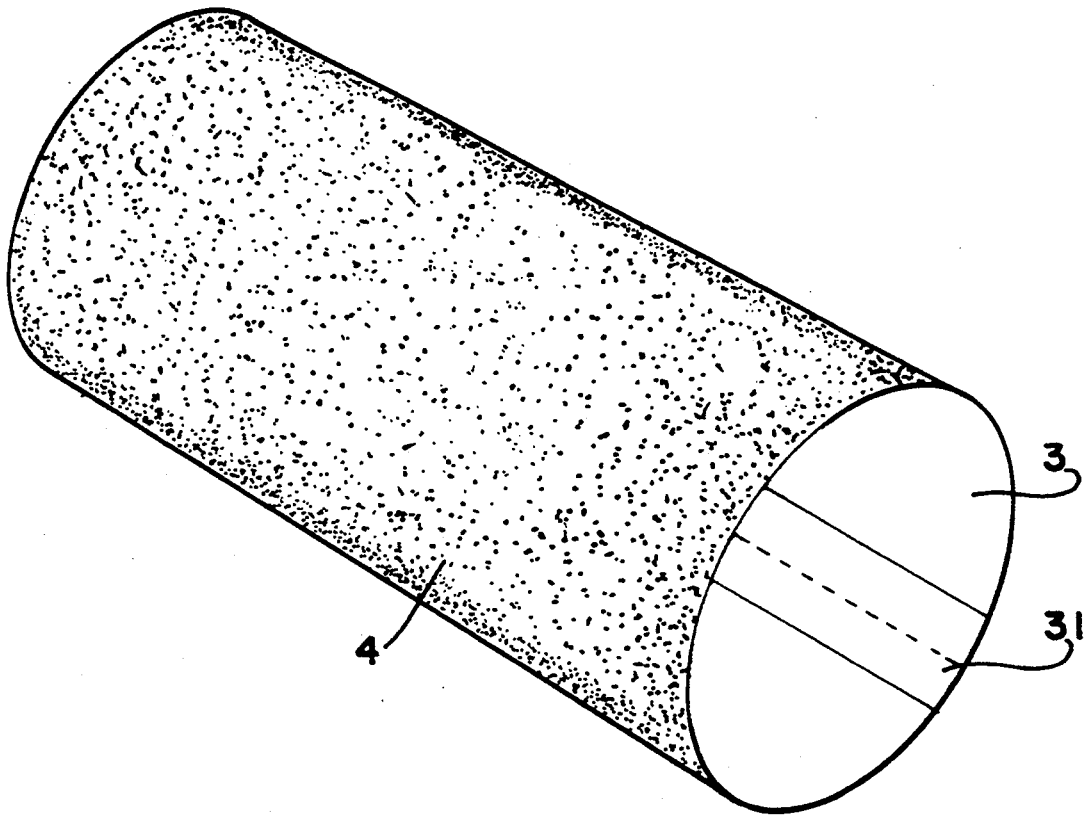
FIG. 4 shows abrasive sheet (3) assembled into tube sheet form (4) ready to install by sliding over sanding device (1).
Figure 9:
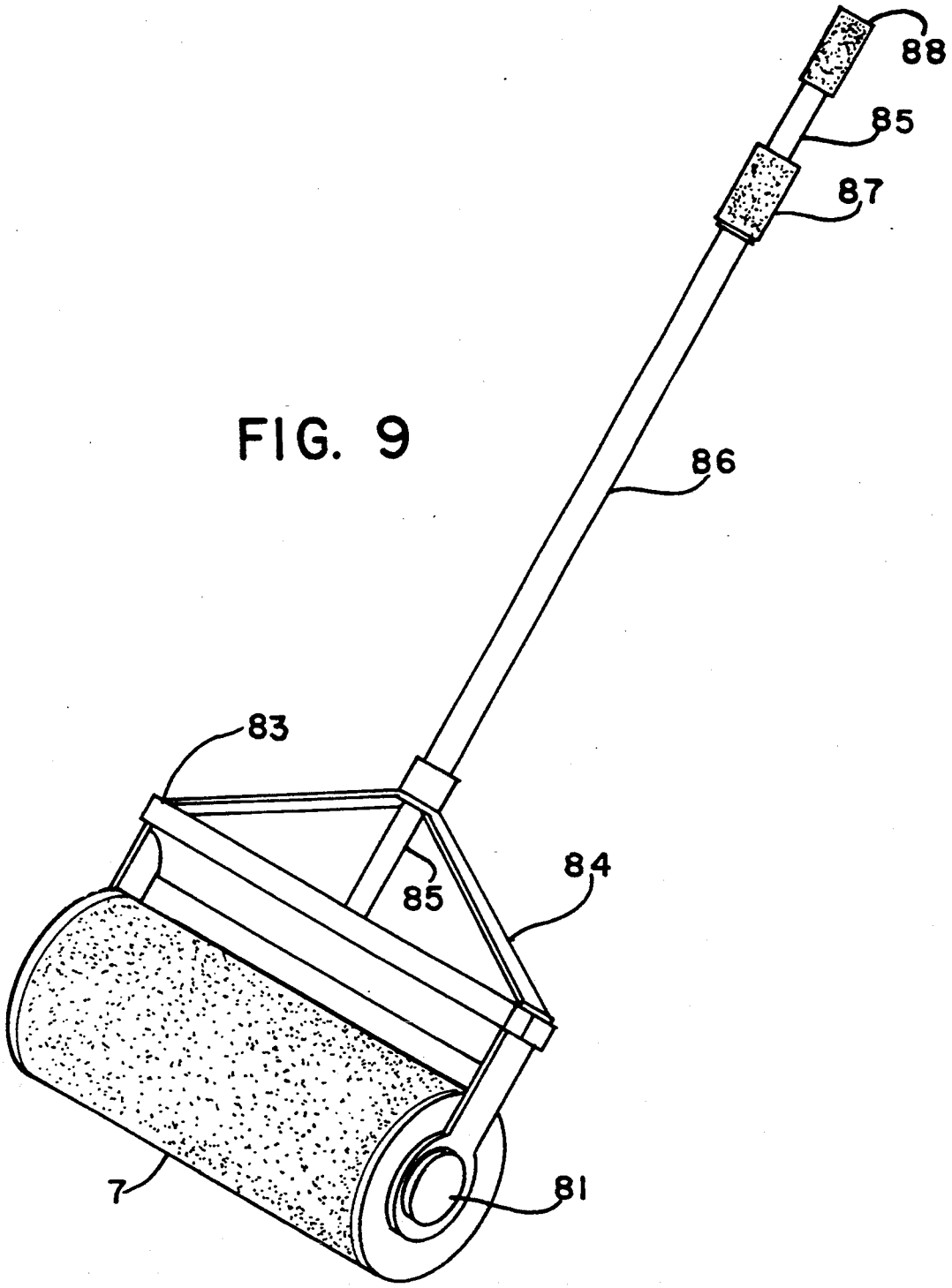
FIG. 9 shows the pole mounting assembly (8) with the stopping blade 83) in free position allowing device to rotate on rod (81).
Figure 10:
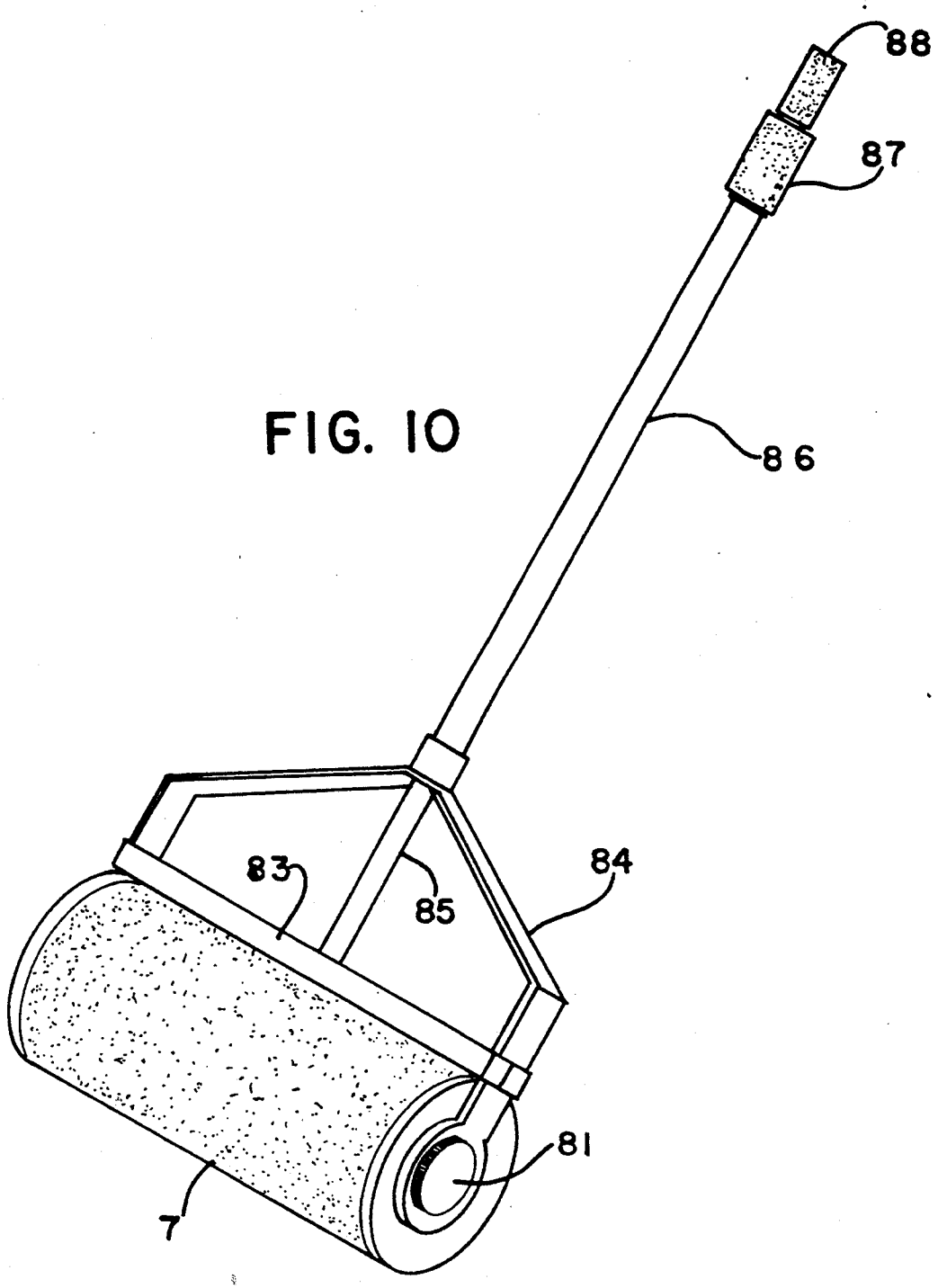
FIG. 10 shows the pole mounting assembly (8) with stop (83) locked in the full break position securing device from rotation.

The device can be bored through with a sleeve inserted as in FIG. 2, allowing device (2) to be secured by rod (81) to pole mounting apparatus (84) as illustrated in FIGS. 9 and 10.

The embodiment of the sanding device can be molded from a combination of the polyurethane and abrasive material thereby incorporating the abrasive materials throughout the embodiment, or surfaced with permanent abrasive coating or layer, allowing said device to be operated without application of abrasive tube sheet (4).

The device (FIGS. 1 and 2), is designed to be used in conjunction with abrasive tube sheet (4), whereas said tube sheet is fastened into a sleeve (4) by adhesive tape (31) to fit snugly over said device as in FIG. (6) and can vary in size, shape, material and coarseness.

The device (2) may be used in conjunction with pole mount assembly (8) whereas said device is inserted between two forks of mounting apparatus (84) and rotates on roller rod (81) which is first inserted through the non threaded side of the mounting apparatus (84), then through center sleeve (21) and screwed into threaded nut (82) on the opposite fork. Threaded nut may be eliminated by threaded hole at center of same opposite fork or by boring both forks and screwing mounting rod through forks to disc screw (89)

The pole mount assembly (FIG. 8), designed to be used in conjunction with device for the purpose of preparing large surfaces where the use of a pole extension is practical or desirable consists of a mounting apparatus (84), onto which is fastened by threaded connection the external pole (86) which is threaded at one end to screw into same mounting apparatus and to which is fastened at other end a handle (87) which contains an internal compression fitting that, when tightened, compresses onto internal pole (85), thereby locking same in respective position, the stop blade (83) in lock position FIG. 10 securing sanding device from rotation, or in free position FIG. 9 allowing device to rotate on rod (81), with internal pole running through exterior pole and screwed into stop blade (83) with a non slip surfaced handle or grip (88) at opposite end of same internal pole (85). The sanding device (2) or the sanding device with abrasive tube sheet (FIG. 7) is inserted between the two forks of the mounting apparatus (84) with the mounting rod (81) inserted through the bored hole in fork, through sanding device sleeve (21) and into threaded hole in opposite fork, threaded nut (82) inserted into opposite fork or through opposite fork into disc screw (89).

The mounting apparatus (84) can be made to hold more than one sanding devices or longer versions of said sanding device by extending the distance between the forks of said mounting apparatus (84) and lengthening mounting rod (81) and stop (83).

Figures 11A, 11B:
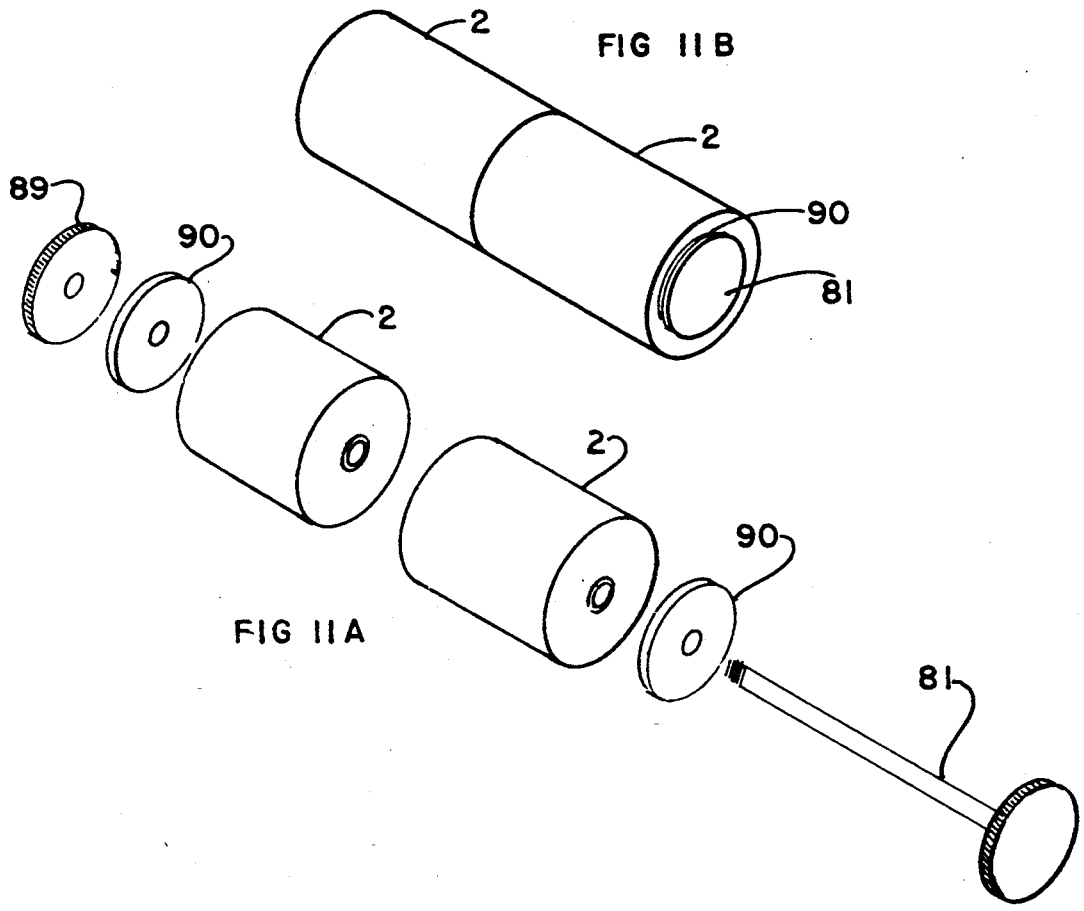
FIG. 11 shows multiple devices connected together with FIG. 11*a* showing exploded view and FIG. 11*b* assembled view.

The roller rod (81) can be manufactured to different lengths to accommodate longer, or a multitude of sanding devices (2) to be either attached to pole mount assembly (8) or in connection to roller rod disc nut (89) for use by hand of multiple sanding devices (2) as in FIG. 11.

The abrasive tube sheet (3) can be manufactured to various sizes with the standard size being that of the present industry standard of 9 inches (22.9 cm) by 11 inches (28 cm). The abrasive sheets can be fastened together to provide respective increases in the diameter of the tube sheet (4).

The abrasive tube sheet (4) can vary in the coarseness, grit and type including wet type for the purpose of wet sanding as is common in metal finishing.

From the above description, a number of advantages of my sanding device become evident:

a) The sanding device, when used in conjunction with abrasive sheet, is easily loaded with same without the use of any clamping means to secure said abrasive sheet.

b) The sanding device can be operated by hand by grasping same device or pole mounted allowing for universal application of sanding device to any sanding operation.

c) The sanding device, manufactured by molding of flexible polyurethane foam will conform to a wide range of opposing work surface contours and profiles ranging from flat to profiles involving numerous shapes, inside and outside corners.

D) The sanding device, when used in conjunction with abrasive tube sheet, can be quickly and easily loaded with the tube sheet and operated by a person with extremely limited physical dexterity or who is physically disabled or handicapped.

e) The sanding device can be manufactured from a combination of polyurethane and abrasive materials or skinned with an abrasive surface eliminating the need, until worn, for the abrasive tube sheet.

f) The device, manufactured through molding process to an unskinned surface, when, manufactured to lower densities, is porous and will absorb water which can be disbursed by pressure through a perforated wet sanding abrasive tube sheet to the opposing work surface as in metal finishing.

g) The device is used in conjunction with standard sized abrasive sheets easily formed into the tube sheet.

h) The sanding device can be manufactured to various diameters and lengths and can be combined with more sanding devices, FIG. 11, to increase the area of the working surface on the opposing work surfaces thereby increasing the production.

i) The device is safe to use with no possibility of injury to the user from pinching or lacerating.

OPERATION

The basic operation of the tool is by grasping or gripping the sanding device (1) by hand and performing the sanding operation by applying force down on the work surface while sliding the device back and forth, in any direction, as in any sanding operation.

The sanding device can be combined with additional sanding device(s) (FIG. 11) by bolting same together with mounting rod (81) inserted through devices and screwed into disc nut (89).

The tube sheet is formed into a tube shape by securing one edge of the abrasive sheet (3) to its opposing edge and fastening or securing same edges together by use of adhesive strip (31).

Figure 5:
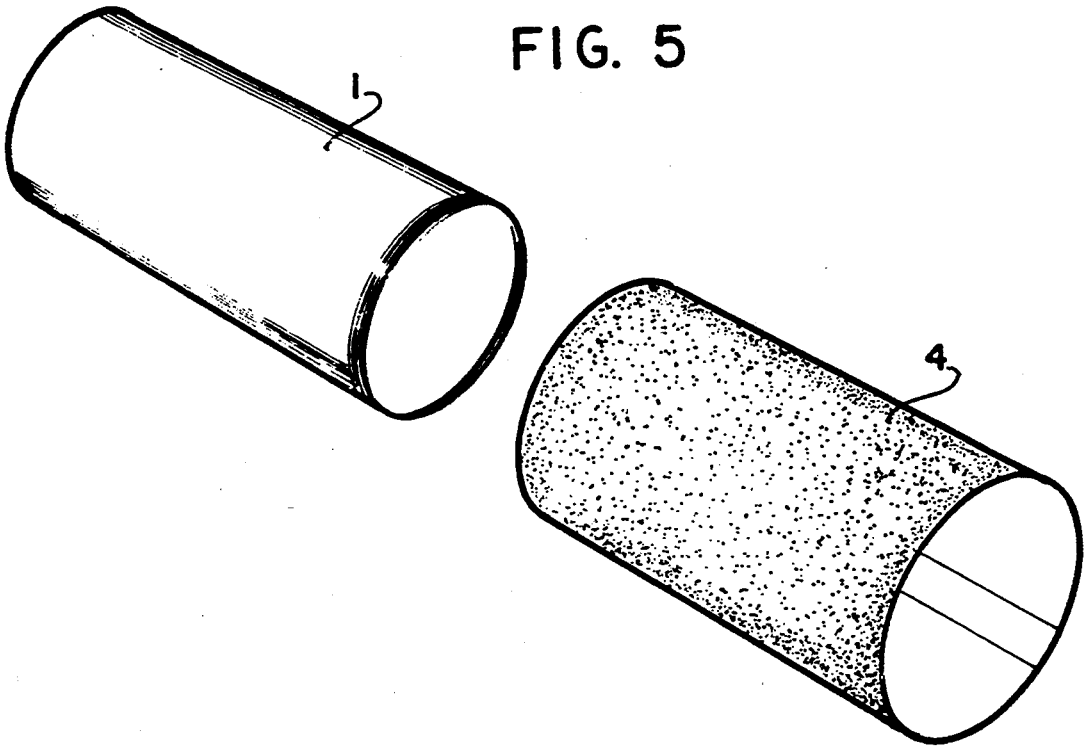
FIG. 5 shows the abrasive tube sheet (4) exploded from and ready to apply over sanding device (1).
Figure 6:
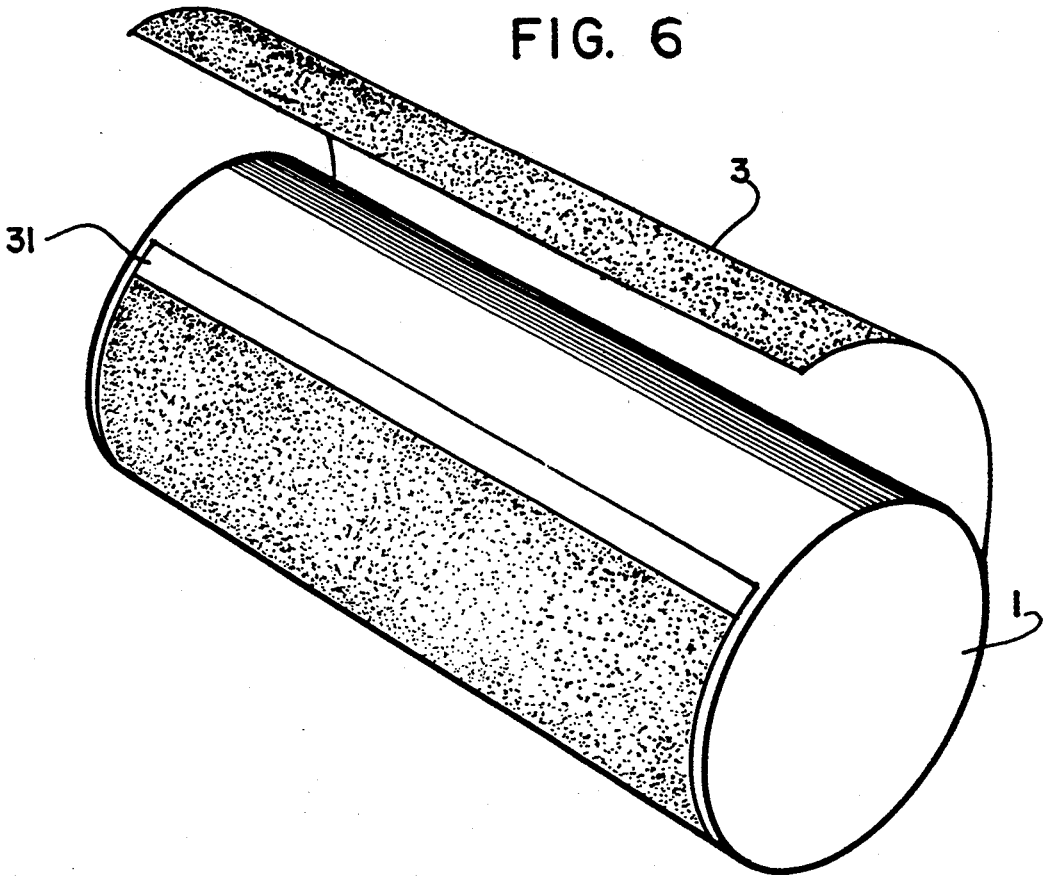
FIG. 6 shows the sanding device (1) with the abrasive tube sheet (4) ready to be assembled directly around sanding device.

When sanding device (1) is used in conjunction with abrasive tube sheet (4) same tube sheet is either pre assembled into tube sheet and slid over the sanding device (1) as shown in FIG. 5 or assembled directly around sanding device as in FIG. 6.

Figure 7:
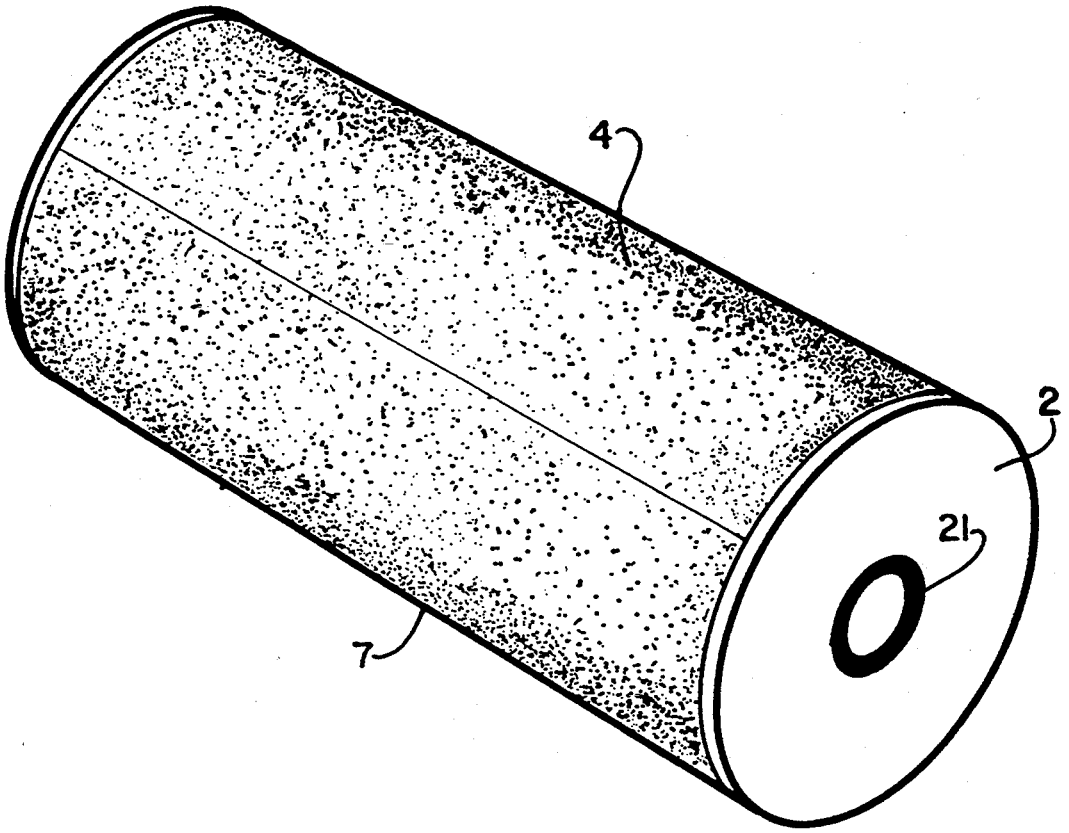
FIG. 7 shows sanding device (1) with tube sheet (4) installed.
Figure 8:
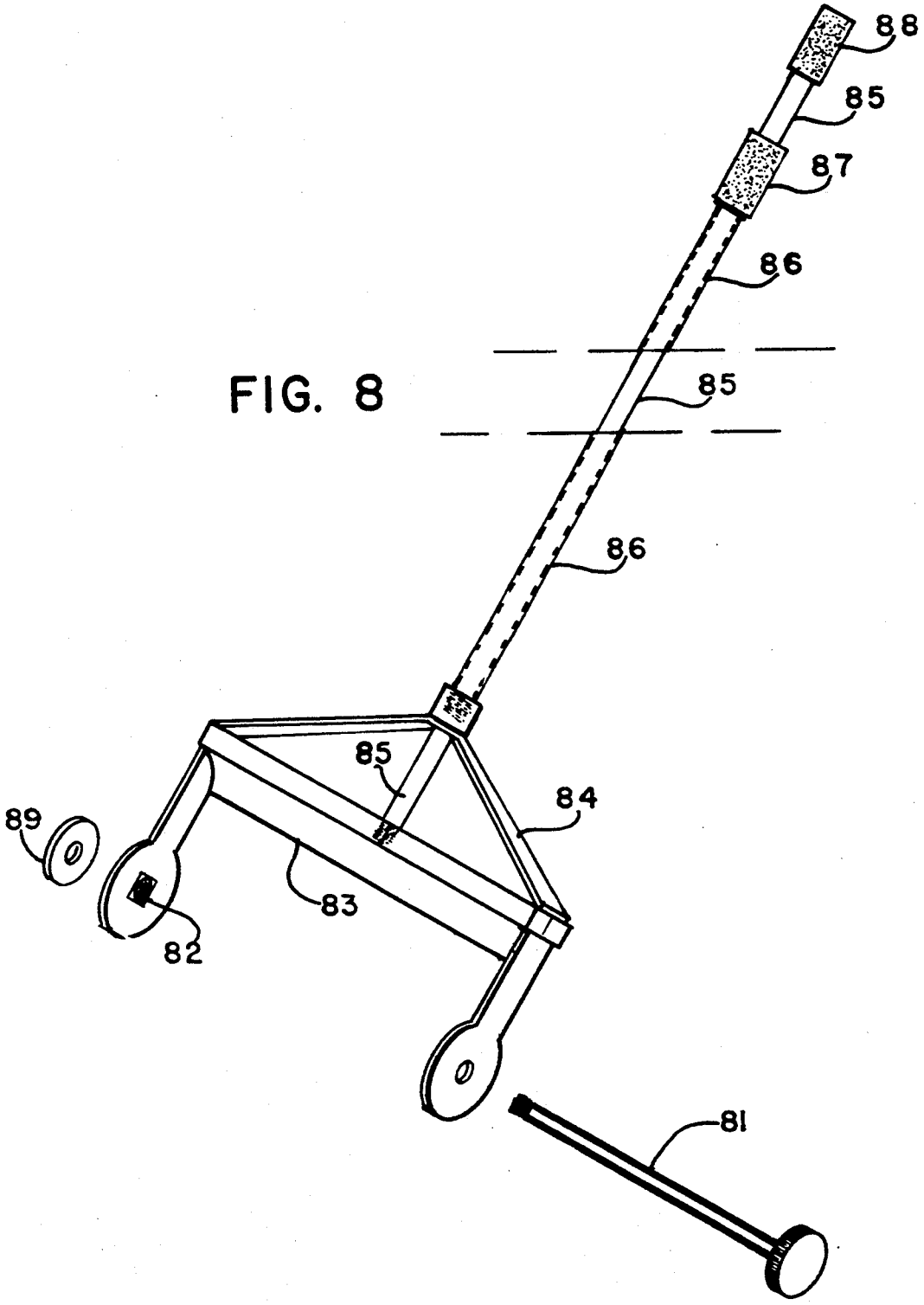
FIG. 8 shows the pole mounting assembly (8) with the pole mounting screw rod (81) exploded from the assembly.

The operation of the sanding device with tube sheet applied as shown in FIG. 7 is performed the same as the sanding device not requiring abrasive tube sheet by applying pressure down on the working surface and sliding sanding device back and forth.

The sanding device (2) when manufactured with mounting rod sleeve (21) is mounted to the pole mount (FIG. 8) by insertion between the forks of the mounting apparatus (84) followed by sliding mounting rod (81) through hole in first fork, through rod sleeve (21) and screwed into threaded receptacle on the opposite fork of the mounting apparatus (84). When in operation, the stop (83 ) is forced down onto the back side (non working surface) of the sanding device by pushing internal pole (85) down against same sanding device and locking stop (83) into position by twisting threaded exterior pole handle (87) forcing internal expansion collar to tighten around internal pole (85) FIG. 10. When rotation stop (83) is locked in stop position the sanding device is then placed on the work surface and operated by grasping the pole and applying pressure to same work surface while pushing and pulling the sanding device across the work surface. Once the working abrasive surface becomes worn, the rotation stop is released by unscrewing the exterior rod handle which allows the internal compression fitting to release the internal pole which is then slid away form the sanding device, as in FIG. 9, allowing same sanding device to be rotated to an unused area of the abrasive surface of the sanding device or abrasive tube sheet, then locked back in stop position.

When performing wet sanding operations, the unskinned water absorbing flexible polyurethane foam sanding device is saturated with water, loaded with abrasive tube sheet, placed on the opposing work surface and squeezed prior to beginning of the sanding motion, allowing water to be disbursed through the perforated wet sanding abrasive tube sheet or the ends of the sanding device, onto the working surface.

SUMMARY, RAMIFICATIONS AND SCOPE

Accordingly, the reader will see that the sanding device of this invention can be manufactured from inexpensive materials, can be of the type with abrasive materials incorporated into the materials of the embodiment, surfaced with an abrasive skin or used in conjunction with abrasive sheets formed into the shape of a tube which is slid directly over the cylindrically shaped sanding device, although, the device is not limited a cylinder shape as it can be molded into a wide range of shapes and sizes. The sanding device is easily loaded with the abrasive tube sheet, is comfortable to the grip or grasp, is easily used, aids in the productivity of the user, and efficiently uses 100% of the attached abrasive tube sheet. Furthermore, the sanding device of this invention has additional qualities in that:

a) It is flexible and manufactured to various compressive strengths allowing for a wide range of applications.

b) It will take the shapes of various contoured, profiled, curved and flat opposing work surfaces, reach inside corners and conform to outside corners.

c) It can be manufactured to be water absorbing for use in wet sanding operations as in metal finishing.

d) When used in conjunction with abrasive tube sheets, the assembly and fastening of same tube sheets and operation of the sanding device is easily performed even by persons with physical disabilities.

e) The sanding device can be either pole mounted for work surfaces like walls, ceilings and floors, or operated by hand by gripping or grasping same sanding device.

f) The sanding device is be molded from various combinations of materials into a wide range of shapes and sizes.

Although the description above contains many specificities, these should not be construed as limiting the scope of the invention but as merely providing illustrations of some of the preferred embodiments of this invention.

Thus, the scope of the invention should be determined by the appended claims and their legal equivalents, rather than just the examples given.

I claim:

1. A sanding device consisting of a connecting rod threaded at each end with a disc shaped nut fastened to each threaded end of said connecting rod securing at least two polyurethane foam cylinders having central bores with pipe shaped sleeves fastened within said central bores to accept said connecting rod with the outside surfaces of said foam cylinders covered by tube shaped abrasive sheets formed from flat sheets of abrasive paper or cloth having a strip of adhesive tape having half of the adhesive surface applied to the back sides of one end of said abrasive sheets with the remaining adhesive surface covered with a protective tab which when removed allows for the fastening of the back sides of opposite ends of same abrasive sheet together forming the respective tube shaped abrasive sheet, said abrasive sheets each having on inside diameter sized to snugly fit the outside of a respective said foam cylinder which when applied over said foam cylinder is held in place by friction between the abrasive sheets and the foam cylinder, to form a respective sanding element, said sanding elements being combined together by placing said cylinders and their respective abrasive tube-sheets over said connecting rod securing a multiplicity of sanding elements together by said disc shaped nuts being tightened onto each threaded end of said connecting rod.

2. A pole mounted sanding device consisting of a pole mount assembly to which is secured a polyurethane foam cylinder over which is applied a tube shaped abrasive sheet which is formed from a flat sheet of abrasive paper or cloth having a strip of adhesive tape having half of the adhesive surface applied to the back side of one end of said abrasive sheet with the remaining adhesive surface covered with a protective tab which when removed allows for the fastening of the back side of opposite ends of same abrasive sheet together forming the tube shaped abrasive sheet having an inside diameter sized to snugly fit the outside of said foam cylinder which when applied over said foam cylinder is held in place by friction between the abrasive sheet and the foam, the foam cylinder having a central bore with a pipe shaped sleeve secured by adhesion to said foam cylinder within said central bore, said cylinder being mounted on a pole mounting rod which is threaded at one end with a disc shaped stop on one end and a disc shaped nut at an opposite end or threaded at both ends and having a disc shaped nut at each end for the purpose of tightening said mounting rod with said foam cylinder and abrasive tube sheet assembly to a set of mounting forks of said pole mount assembly, said mounting forks being fastened to an outer pole having a compression fitting at opposite end and containing an inner pole sized with an outside diameter slightly smaller than the inside diameter of the outer pole allowing said inner pole to slide snugly but freely through the outer pole with the inner pole longer than said outer pole allowing for a hand grip at the compression fitting end of said outer pole, means to lock and free a stopping brake which is at the opposite end of the pole from the hand grip and slides along the said mounting forks to rest firmly against the abrasive tube sheet covered foam cylinder, thereby securing said cylinder from rotating on said mounting rod by compression of said stopping brake against said abrasive sheet covered foam cylinder assembly, said brake being held into such a locked position by the clamping of the compression fitting on said outer pole to said inner pole.

* * * * *